US006790113B1

(12) United States Patent
Fujita

(10) Patent No.: US 6,790,113 B1
(45) Date of Patent: Sep. 14, 2004

(54) METHOD AND APPARATUS FOR MAKING SPARK PLUG

(75) Inventor: Shigeo Fujita, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 22 days.

(21) Appl. No.: 10/048,181

(22) PCT Filed: May 30, 2000

(86) PCT No.: PCT/JP00/03479

§ 371 (c)(1),
(2), (4) Date: Jan. 29, 2002

(87) PCT Pub. No.: WO01/93389

PCT Pub. Date: Dec. 6, 2001

(30) Foreign Application Priority Data

Nov. 27, 1998 (JP) ..... 10-336742

(51) Int. Cl.[7] ..... H01T 21/00; H01T 21/06

(52) U.S. Cl. ..... 445/7; 445/49; 445/67; 140/71.5

(58) Field of Search ..... 445/7, 49, 60, 445/63, 67; 123/169 EA, 169 EL; 140/71 R, 71.5

(56) References Cited

U.S. PATENT DOCUMENTS

| | | | | | |
|---|---|---|---|---|---|
| 3,898,829 | A | * | 8/1975 | Sydow | 72/125 |
| 3,918,329 | A | * | 11/1975 | Hopkinson | 72/454 |
| 5,471,759 | A | * | 12/1995 | Burrows et al. | 33/567 |
| 5,556,315 | A | * | 9/1996 | Kagawa | 445/7 |
| 5,741,963 | A | | 4/1998 | Nakatani et al. | |
| 5,793,793 | A | | 8/1998 | Matsutani et al. | |
| 5,977,695 | A | | 11/1999 | Osamura et al. | |
| 2002/0094743 | A1 | * | 7/2002 | Harada | 445/7 |
| 2003/0062815 | A1 | * | 4/2003 | Kanao et al. | 313/141 |

FOREIGN PATENT DOCUMENTS

| | | | | | |
|---|---|---|---|---|---|
| DE | 108857 | | | 10/1974 | |
| DE | 264555 | A1 | | 2/1989 | |
| DE | 278449 | A1 | | 5/1990 | |
| DE | 281059 | A1 | | 7/1990 | |
| EP | 0 540159 | B1 | | 3/1996 | |
| EP | 0 872928 | A1 | | 10/1998 | |
| JP | 3-64882 | | | 3/1991 | |
| JP | 05242953 | A | * | 9/1993 | ..... H01T/13/20 |
| JP | 7-253075 | | | 10/1995 | |
| JP | 8-232824 | | | 9/1996 | |
| JP | 2636814 | | | 4/1997 | |
| JP | 11-121144 | | | 4/1999 | |

* cited by examiner

*Primary Examiner*—Ashok Patel
*Assistant Examiner*—Mariceli Santiago
(74) *Attorney, Agent, or Firm*—Sughrue Mion, PLLC

(57) ABSTRACT

This invention relates to a method and apparatus for making a spark plug, in particular, for making a high-performance spark plug having a center electrode having a firing end made of Pt, Ir, Rh, Pd, Re, Os, Ru or alloy thereof, with its firing end diameter of about 0.3–1.0 mm. One of the embodiments provides a method comprising the steps of: extending a metal strip from an end of the metal shell; positioning a spacer above a firing end of the center electrode; preliminarily bending the metal strip toward the spacer so as to form an arc portion in the metal strip; and then precisely forming a gap-distance between the metal strip and the firing end of the center electrode by applying a force to the metal strip. The method may further include a step of measuring the position of the firing end of the center electrode so as to determine a position for the spacer and/or a step of retrieving the spacer after bending the metal strip so that the gap-distance between the metal strip and the center electrode is adjusted to a required value by referring to a position of the preliminary bent metal strip and the position of the firing end of the center electrode. The invention also provides an apparatus for performing this method.

21 Claims, 4 Drawing Sheets

METHOD AND APPARATUS FOR MAKING SPARK PLUG

BACKGROUND OF THE INVENTION

1. Field of the Invention

The invention relates to a method and apparatus for making a spark plug for igniting a fuel gas in an internal combustion engine and more specifically relates to a method and apparatus for precisely making a spark gap between a center electrode and a ground electrode in the spark plug.

2. Description of the Related Art

In recent years, an allowable deviation of the spark gap between a firing end of the spark plug and a metal strip of the ground electrode has been narrowing due to recent requirements for a high performance spark plug usable e.g. in a maintenance-free internal combustion engine. Therefore, contrivances are required to provide a reliable way for making such an accurate distance for the spark gap by precisely bending the ground electrode strip.

In a conventional gap-forming process, the ground electrode strip is bent in a single step by applying a punch to the metal strip that is welded upright to an end face of a metal shell of the spark plug with a spacer inserted between the center electrode and the ground electrode. However, a statistical uniformity of the narrowly-deviated gap distance is not easily attained from one spark plug gap to the other, probably due to various factors such as buckling of the metal strip per se, a welding condition for the strip, deviations of the strip diameter and length, and an extent of projection of the firing end of the center electrode from the metal shell.

Specifically, a high performance spark plug which uses a high-corrosion resistant hard metal tip made from precious metal such as Platinum and/or Iridium having a small diameter of 0.3–1 mm formed on the center electrode will only tolerate a very small deviation of the spark gap from the optimum spark gap. Due to the metal tip additionally welded to the center electrode, e.g. by laser-welding, the extent of projection of the firing end may differ from one spark plug to another. Such a high performance spark plug is described, for instance, in EP 0 872 928, U.S. Pat. No. 5,793,793 and U.S. Pat. No. 5,977,695.

If the spacer is made to abut against such a small-diameter metal tip of the center electrode so as to minimize the deviation, a high compressive force is applied to the metal strip through the spacer as a result of bending the metal strip, which may lead to a possible risk that the small diameter tip welded to the center electrode may crack, be damaged or come off.

SUMMARY OF THE INVENTION

It is therefore an object of the invention to provide a method and apparatus for making a spark plug with a precisely formed spark gap between a ground electrode and a center electrode. It is another preferred object of the invention to provide a method and apparatus for making a precisely formed spark gap between a ground electrode and a firing end of a precious metal tip of a center electrode in a spark plug.

According to the invention, there is provided a method for manufacturing a spark plug comprising a center electrode disposed in a bore formed in a ceramic insulator, a metallic shell fitting outside the ceramic insulator, and a ground electrode forming a spark gap with the center electrode, the method comprising steps of:

extending a metal strip from an end of the metal shell;

positioning a spacer above a firing end of the center electrode;

preliminarily bending the metal strip toward the spacer so as to form an arc portion of the metal strip;

and then precisely forming a gap-distance between the metal strip and the firing end of the center electrode by further applying a force to the metal strip in a parallel direction with a center electrode axis.

In this specification, the phrase "metal strip" refers to any elongate metal member, not limited to any specific cross-sectional shape or aspect ratio.

In one aspect of the invention, it is important that there is provided a spacer above the firing end so that the firing end is protected from being damaged during the step of preliminarily bending the metal strip. In another aspect of the invention, the position of the spacer is determined by referring to the position of the firing end of the center electrode so that the firing end of the center electrode does not touch the firing end of the center electrode and can form the arc portion in the metal strip. In other words, it is preferable that a clearance is provided between the spacer and the firing end of the center electrode so as to protect the firing end.

The arc portion formed in the metal strip assures leveling of a lateral side of the metal strip with the firing end face of the center electrode in the step of precisely forming the gap-distance between the metal strip and the firing end of the center electrode. The spacer has a rounded portion so that the arc portion in the metal strip is made between the ends of the strip by bending the metal strip toward or rather along the rounded portion by e.g. a punch. Instead of the rounded portion of the spacer, a corner-chamfered portion may accomplish the same purpose. It is best to make the arc portion at about the same level as the firing end face of the center electrode.

In a preferred aspect of the invention, the above method may further comprise a step of:

measuring the position of the firing end of the center electrode so as to determine a position for the spacer.

The measurement of the position of the firing end of the center electrode is importantly conducted before positioning the spacer so that the clearance between the spacer and the firing end of the center electrode is formed and maintained before and during bending the metal strip toward the spacer which is protecting the firing end of the center electrode.

In the same way as above, the firing end of the center electrode that has a firing tip having a small diameter, such as in the range of from 0.3 to 1.0 mm, is protected. The tip is preferably formed from metal selected from a group consisting of Pt, Ir, Rh, Pd, Re, Os, Ru or alloy thereof and is welded on the center electrode to form the firing end of the center electrode.

In a further preferred aspect of the invention, either of the above defined methods may further comprise a step of:

retrieving the spacer after bending the metal strip so that the gap-distance between the metal strip and the center electrode is adjusted to a required value by referring to a position of the preliminary bent metal strip and the position of the end of the firing metal.

In this preferred embodiment above, it is advantageous to retrieve the spacer after preliminarily bending the metal strip, because the gap distance between the metal strip (namely the ground electrode) and the firing end of the center electrode is easily measured or determined, for example, by a computer-controlled visual image processor that outputs to a metal-strip bending machine how much the gap distance between the ground electrode and the center electrode should be further narrowed or adjusted based on a side-view measurement of the gap distance.

In a preferred aspect of the invention, it is useful that information relating to the position of the firing end of the center electrode is stored in a computer memory so that the information is used for positioning the spacer. This information can be advantageously used also for the step that follows, in which step a gap-distance between the metal strip and the firing end of the center electrode is precisely formed or adjusted.

In yet another aspect of the invention, positional information is determined with reference to a position of a part constituting the spark plug. If a reference position is taken from an end of the metal shell by e.g. a position-detecting sensor using laser, the position of the firing end means how much the firing end of the center electrode is projected from the end of metal shell to which the metal strip is extendedly welded, thereby giving the positional information that directs how much above the spacer should be placed from the firing end of the center electrode and/or whereat the arc portion is formed in the metal strip.

In still another aspect of the invention, the positional information of the firing end of the center electrode can be used not only for positioning the spacer above the firing end as described above but also for precisely forming a gap-distance between the metal strip and the firing end of the center electrode. In this case, positional information is only required for the bent metal strip (of the ground electrode).

In a further aspect of the invention, the force applied to the metal strip for precisely forming the gap distance is caused by a punch or die moving in parallel with a center electrode axis of the spark plug. Alternatively, the preliminary bending of the metal strip may be done by a punch or die moving in perpendicular to the center electrode axis, or in a combined direction having both of these directions.

The present invention further provides an apparatus adapted to perform any of the above methods.

BRIEF DESCRIPTION OF THE DRAWINGS

Embodiments of the invention will now be described, by way of example only, with reference to the accompanying drawings in which.

DETAILED DESCRIPTION OF THE INVENTION

A spark plug used for igniting a fuel gas in a combustion engine comprises a center electrode penetratingly disposed through a bore formed in an alumina ceramic insulator that electrically insulates the center electrode from a metallic shell fitted outside the ceramic insulator. The metal shell has a threaded portion to be screwed into a bore of the engine and an end face from which a ground electrode is extended as a ground electrode. A gap is made between a firing end of the center electrode and the metal strip (namely the ground electrode) so as to make a spark between the electrodes when a high voltage is applied across the electrodes.

The firing end of the center electrode is desirably pointed from a view point that the spark occurs easily. However, such a pointed firing end tends to erode or wear very quickly under a continuous spark condition inside the engine. For this reason, a spark-erosion resistant metal such as platinum and Ir-Rh(5–30%) alloy has come to be used as an firing end tip having a small diameter of about 0.3–1 mm. This spark-erosion resistant metal tip having a length of about 0.2–1 mm is preferably welded at an conical end of the center electrode by applying a laser. The center electrode disposed firmly inside the ceramic bore has a comparatively large diameter of 1.5–3 mm. The material of the center electrode to which the metal tip is welded is normally an nickel-based alloy.

EXAMPLE

A method and apparatus for making a spark plug, embodied according to the invention, will now be explained and described in detail by referring to the accompanying drawings.

Figure 1:
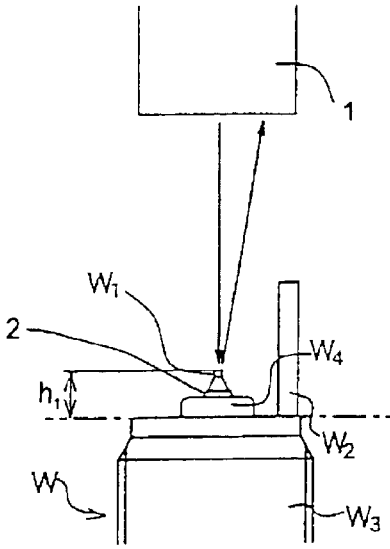
FIG. 1 an explanatory drawing for partly explaining a method and/or apparatus for making a spark plug according to the invention, showing a schematic view of a spark plug (W) having a straight metal strip ($W_2$) for forming a ground electrode which is welded uprightly to an end of a metal shell ($W_3$), wherein a position of a firing end of a precious metal tip ($W_1$) formed on the center electrode is determined by a position-detecting sensor 1 using a laser.

Referring to FIG. 1, an end of a straight metal strip ($W_1$) for a ground electrode of the spark plug (W) is connected to an circular end of a metal shell ($W_3$) by a resistance-welding method. A material of the metal shell ($W_3$) is preferably made of carbon steel. Nickel containing iron is used for a material of the metal strip ($W_2$).

The center electrode 2 has a conical end made of a high temperature resistant metal such as Inconel 600 (trade name). A metal tip ($W_1$) made of a spark-erosion resistant metal such as Ir-20%Rh, Ir-5%Pt, Ir-1.5%$Y_2O_3$ and Pt-20%Ir is welded to the conical end of the center electrode. The metal tip ($W_1$) having a diameter of about 0.3–1 mm and a length of about 0.2–0.9 mm is welded to the conical end of the center electrode 2 by applying a laser beam to an interface between the tip ($W_1$) and the conical end.

Figure 2:
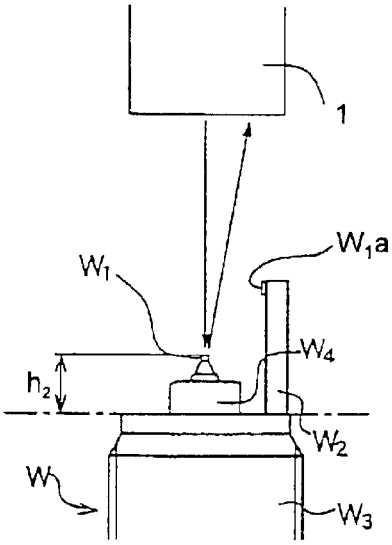
FIG. 2 is an explanatory drawing for partly explaining a method and/or apparatus for making a spark plug according to the invention, showing a schematic partial view of a spark plug in the same process as shown in FIG. 1, but different in a position of the firing end and having a metal plate tip ($W_1$a) welded on the metal strip ($W_2$).

When the metal tip ($W_1$) is required at the conical end of the center electrode 2 so as to have a spark-erosion resistance firing end, a small plate tip ($W_1$a) of spark-erosion resistance material such as Pt-20%Ni is optionally welded on an lateral side of the metal strip ($W_2$) as shown in FIG. 2 so as to also enhance the spark-erosion of to the ground electrode. Since the metal strip for the ground electrode is uprightly and/or straightly formed during this step, a best position of the erosion resistance plate tip ($W_1$a) to be welded to the metal strip ($W_2$) is advantageously determined by referring to the position of the firing end of the metal tip ($W_1$). In other words, if the position of the firing end of the center electrode is detected as at a higher position, the position of the plate tip ($W_1$a) is elevated accordingly so as to face the plate tip ($W_1$a) with the metal tip ($W_1$) just in place by bending the metal strip ($W_2$) in a gap-forming step as will be described later.

The metal plate tip ($W_1$a) is normally in thickness of 0.2–0.5 mm and is made of a spark-erosion resistant metal which can be made of Pt, Ir, Rh, Pd, Re, Os, Ru, Ni or alloy thereof.

After the step wherein the metal strip ($W_2$) is uprightly or straightly formed on the end of the metal shell($W_3$), as shown in FIG. 1 or FIG. 2, a position-detecting sensor 1 measures a position of an end of the metal tip ($W_1$) formed on the conical end of the center electrode 2 by emitting a laser light to an end face of the metal tip ($W_1$) and gathering a reflected laser light therefrom. The position of the metal tip ($W_1$) means, in this case, a distance between the metal tip end face and the position-detecting sensor 1. The distance measured by the sensor 1 is longer in the case of FIG. 1 than that measured in the case of FIG. 2, because the insulator ($W_4$) holding the center electrode in FIG. 2 is projecting more than the insulator of FIG. 1. In other words, the position of the metal tip ($W_1$) in FIG. 1 indicates that a height ($h_1$) of the center electrode measured from the end of the metal shell ($W_3$) in FIG. 1 is less than the height ($h_2$) of the center electrode in FIG. 2.

After the position of the metal tip ($W_1$) is determined as explained in the above step, a step of preliminarily bending the metal strip ($W_2$) is provided, as will be explained hereafter with reference to FIG. 3 and FIG. 4.

Figure 3:
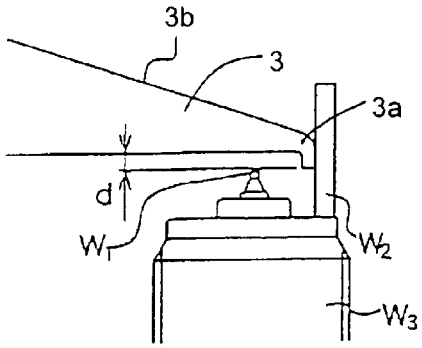
FIG. 3 is an explanatory drawing in use for partly explaining a method and/or apparatus for making a spark plug according to the invention, showing a schematic partial view of the spark plug in process wherein a rounded portion of a spacer 3 abuts against a lateral portion of the metal strip ($W_2$) and the spacer 3 has a clearance (d) formed between the spacer 3 and the firing end of the precious metal tip ($W_1$).
Figure 4:
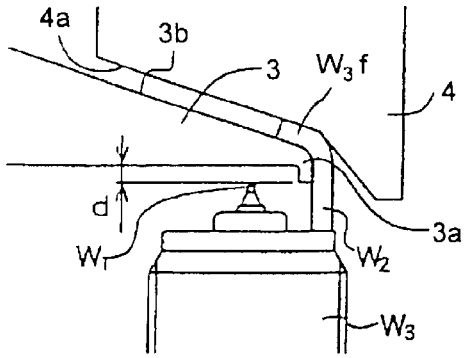
FIG. 4 is an explanatory drawing for partly explaining a method and/or apparatus for making a spark plug according to the invention, showing a schematic partial view of the spark plug in process wherein a punch 4 has bent the metal strip ($W_2$) in a middle of the metal strip ($W_2$) by pushing the metal strip ($W_2$) along the rounded portion of the spacer 3.

A spacer 3 is placed at the position spaced away from the end of the metal tip with a clearance (d) between the spacer 3 and the metal tip ($W_1$) as shown in FIG. 3. This clearance has a relation with the position of the metal tip end measured in the previous step. In other words, the spacer 3 can be placed above the metal tip ($W_1$), without touching the tip, by referring to positional information of the metal tip. When a statistical data is gathered on the heights or positions of many metal tips formed on the center electrodes of the spark plugs, the clearance (d) should be determined as more than the maximum height computed based on such statistical data. In such a statistical case in mass production, it may be unnecessary to measure the position of the metal tip ($W_1$) every time before the spacer 3 is placed above the metal tip.

The spacer 3 has a rounded nose portion (3*a*) at its end and a back face (3*b*) slanting up from the rounded portion. The rounded nose portion (3*a*) abuts against a lateral side of the metal strip ($W_2$) as shown in FIG. 3. Then as shown in FIG. 4, a punch 4 having a slanting end face (4*a*) moves downward from the above position of the metal strip ($W_1$) to apply a force to the metal strip ($W_2$) and to bend the metal strip along the rounded nose portion (3*a*). The punch 4 may move horizontally to bend the strip along the rounded portion (3*a*). It is preferable that the punch 4 has the same slanting angle as that of the spacer back (3*b*).

As a result of the force thus applied, an arc portion is formed in the metal strip ($W_2$), maintaining a straight free end portion ($W_3$f). A bending angle for the metal strip ($W_2$) is preferably about 110–135 degrees at this preliminary bending step.

It is important that the spacer 3 protects the metal tip ($W_1$) forming a pointed firing end of the center electrode during the preliminary bending step, since such a small diameter of 0.3–0.7 mm is mostly selected for the pointed firing end of a high performance spark plug. In addition, the spacer should be rigid and tough so that the spacer does not deform or break during the preliminary bending step in mass production of spark plugs, eliminating any chance of causing any damage to the metal tip ($W_1$) or not touching the metal tip in any event. One of the recommended materials for the spacer is an alloy tool steel of SKD11 (shown in JIS G 4404) which is also wear-resistant.

Figure 7:
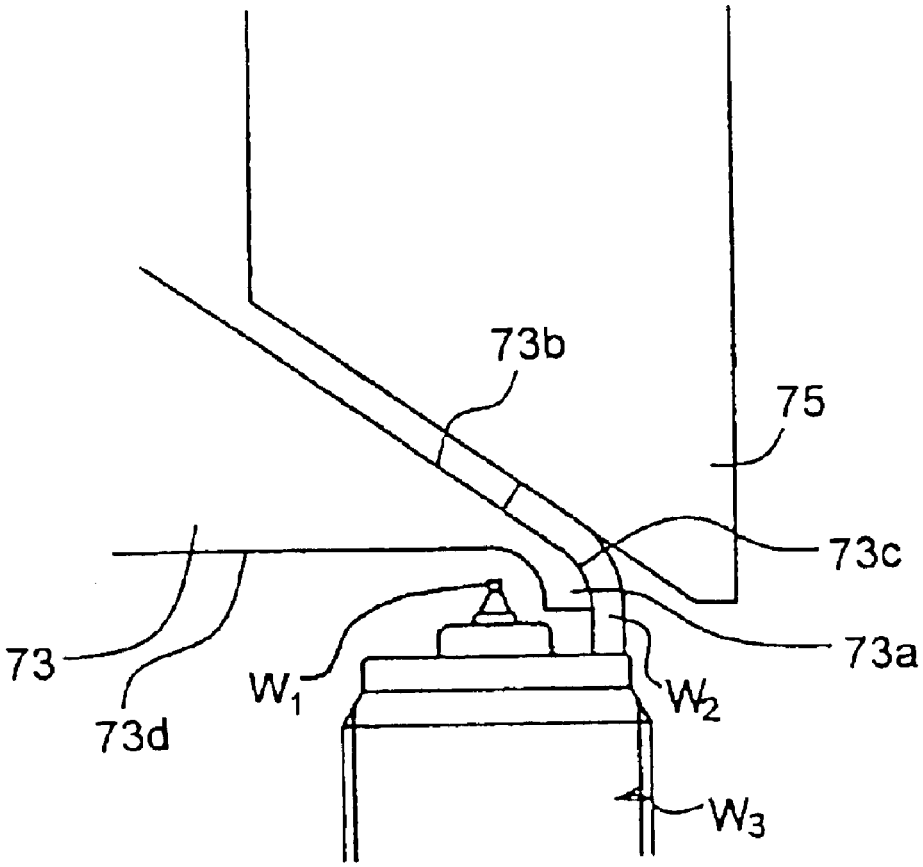
FIG. 7 is an explanatory drawing for partly explaining a method and/or apparatus for making a spark plug according to the invention, similar to FIG. 4 but different in a shape of the die 75 and a shape of the spacer 73 that is capable of forming an arc portion in the metal strip ($W_2$)at about the same level with the firing end of the center electrode.

The spacer can have a different shape. For instance, the spacer 73 as shown in FIG. 7 has a rounded nose portion (73*a*) extending downward more than the one (3*a*) in FIGS. 3 or 4, assuring that the position of the arc portion (73*c*) is formed at about the same level of the firing end and maintaining a protection clearance between the firing end of the metal tip ($W_1$) and the spacer 73. When the position of the arc portion made in the metal strip ($W_2$) is at about the same horizontal level with the metal tip end face, it is easy to bend the metal strip and to make the lateral side of the metal strip in parallel with the end face of the metal tip ($W_1$) in the following step.

Figure 5:
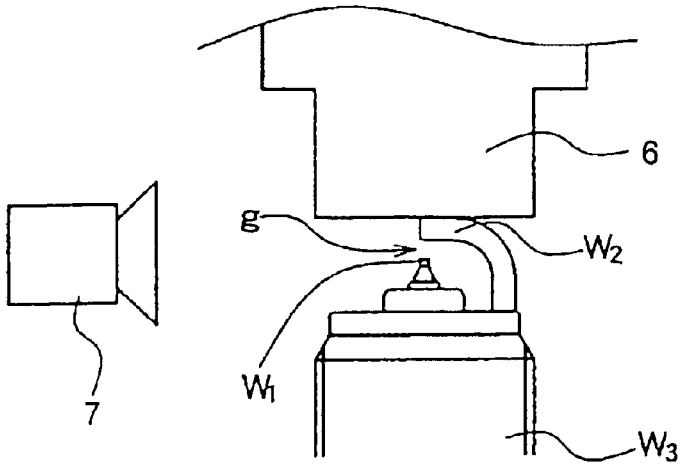
FIG. 5 is an explanatory drawing for partly explaining a method and/or apparatus for making a spark plug according to the invention, showing a schematic partial view of the spark plug in process wherein a die 6 pushes a preliminary-bent metal strip ($W_2$) to form precisely a spark gap (g) between the metal strip($W_2$) and the metal tip ($W_1$) with assistance of a visual-image processor 7.

After the spacer 3 is retrieved or moved away from the position as explained above with FIG. 4, instead of the punch 3, a die 6 having a horizontally flat face as seen in FIG. 5 comes downward in an axial direction of the center electrode to push an outer lateral side of the metal strip ($W_2$) so as to make an inner side of the metal strip to be almost in parallel with the end face of the metal tip ($W_1$). In this step, the gap-distance (g) between the metal strip ($W_2$) and the metal tip ($W_1$) can be precisely formed by referring to the positional information data of the metal tip ($W_1$) memorized in the computer memory. A visual-image processor 7 using e.g. a CCD (charge coupled device) for detecting the gap-distance may check whether the gap-distance (g) is formed within a required value as seen in the FIG. 5 or may assist to precisely form the gap distance (g) by referring to the gap distance measured by the processor 7. The required value for the high performance spark plug in actual use is for instance 1.1 mm with a tolerance of +0 and −0.1 mm.

Figure 8:
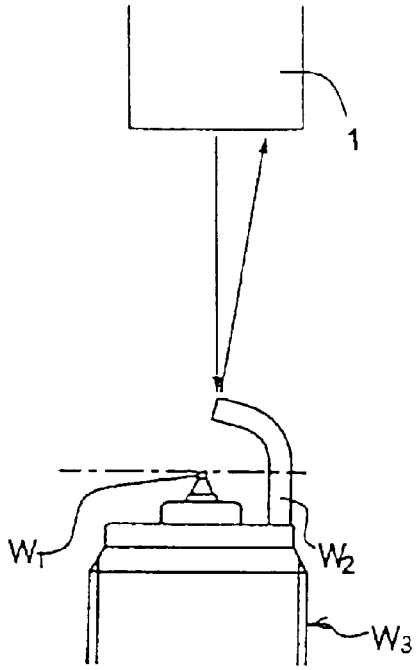
FIG. 8 shows an explanatory drawing for partly explaining a method and/or apparatus for making a spark plug according to the invention, wherein a position of the preliminarily-bent metal strip ($W_1$) is measured by the position-detecting sensor 1.
Figure 9:
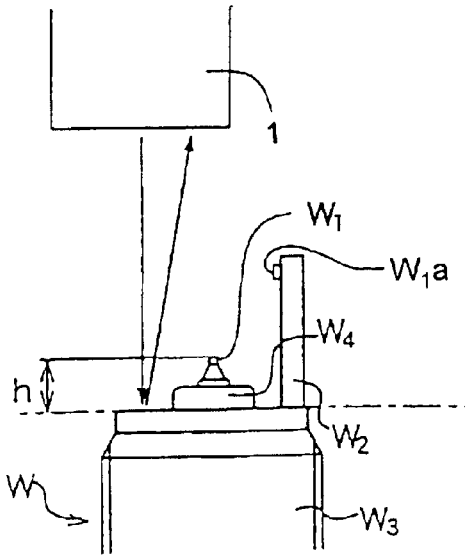
FIG. 9 shows an explanatory drawing in use for partly explaining a method and/or apparatus for making a spark plug according to the invention, wherein a position of the end of metal shell ($W_3$) is measured by the position-detecting sensor

As shown in FIG. 8 or FIG. 9, the position-detecting sensor 1 using a laser can also determine the position of the preliminary bent metal strip ($W_2$) or of the end face of the metal shell ($W_3$). In the case that the position of the preliminary bent metal strip is determined as shown in FIG. 8, how much the preliminary bent metal strip should be further bent can be computably determined by comparing with the positional data of the spark -erosion metal tip ($W_1$). In the case that the position of the end face of the metal shell ($W_3$) is determined as shown in FIG. 9, not only the height (h) of the metal tip, namely the distance from the end face of the metal shell ($W_3$) to the firing end of the metal tip ($W_1$) can be computably determined by comparing the positional information data of the metal tip ($W_1$), but also the spark-erosion resistant metal plate tip ($W_1$a) can be welded onto a best place of the metal strip ($W_2$) as described previously by referring to the data of the height (h) thus computably determined. These positional information and data in part or whole or in modification can be usable in accomplishing the invention.

Figure 6:
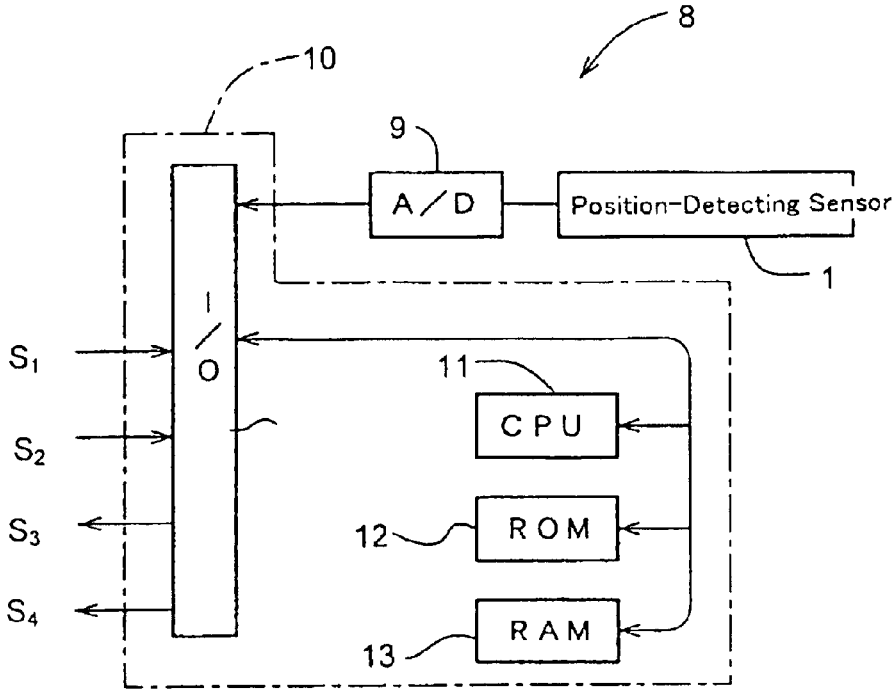
FIG. 6 shows a block diagram of a gap-forming controller 8, wherein a position-detecting sensor 1 sends a positional information of the firing end to be digitally stored in a computer memory (ROM or RAM) for use in preliminarily bending the metal strip and/or precisely forming the gap distance.

Referring now to FIG. 6 showing a gap-forming controller 8 for a gap-forming apparatus, the positional information analogously measured by the position-detection sensor 1 may be electrically converted into a digital information form through an analog/digital converter 9 so as to be stored in a memory of a computer 10 having CPU 11, ROM 12 and RAM 12 through a I/O port and a gap-forming program and/or may be computed directly or indirectly by the computer 10, so as to send or receive signals ($S_1$, $S_2$, $S_2$, $S_4$ . . . $S_n$) to or from the gap-forming apparatus.

For instance, when a signal ($S_1$) informing that the metal strip ($W_1$) is welded to the metal shell ($W_3$) is received by the computer 10, the computer 10 sends out a signal ($S_3$) to the dimension-detecting sensor 1 to measure the positions of the metal tip ($W_1$) and/or the end face of the metal shell as seen in FIG. 1 or FIG. 9. Then, based on positional information data gathered in the computer 10 and computation, the computer 10 sends a signal ($S_4$) to a preliminary bending machine ordering to place the spacer 3 above the metal tip ($W_1$) with such a clearance between the spacer 3, 73 and the metal tip ($W_1$) for forming the arc portion in the metal strip ($W_2$).

When a signal ($S_2$) informing that the spacer is placed at the required position is received, the computer 10 sends a signal ($S_n$) to a punch-machine to come down and preliminarily bend the metal strip to form the arc portion. In a similar way, when the computer 10 receives a signal that the preliminary bending is over, the processor orders the punch-machine to retrieve the spacer 3, 73 and after the retrieval is confirmed the processor orders a die-machine and a visual-image processor to cooperate in further bending the metal strip ($W_1$) so as to make or adjust the gap-distance to be within a required value for the high performance spark plugs based on the positional information data.

What is claimed is:

1. A method for making a spark plug comprising a center electrode disposed in a bore formed in a ceramic insulator, a metallic shell fitting outside the ceramic insulator, and a ground electrode forming a spark gap with the center electrode, the method comprising the steps of:

providing a metal strip which extends from an end of the metal shell, said metal strip being for forming said ground electrode;

positioning a spacer above a firing end of the center electrode so as to make a clearance between the spacer and the center electrode;

preliminarily bending the metal strip toward the spacer without the spacer contacting the center electrode so as to form an arc portion in the metal strip;

and then precisely forming a gap-distance between the metal strip and the firing end of the center electrode by applying a force to the metal strip.

2. A method according to claim 1, further comprising a step of:

measuring the position of the firing end of the center electrode so as to determine a position for the spacer.

3. A method according to claim 2, wherein, a clearance between the spacer and the firing end of the center electrode is determined based on the measured position of the center electrode.

4. A method according to claim 1, further comprising a step of:

retrieving the spacer after bending the metal strip so that the gap-distance between the metal strip and the center electrode is able to be adjusted to a required value by referring to a position of the preliminary bent metal strip and the position of the firing end of the center electrode.

5. A method according to claim 1, further comprising a step of:

welding a metal plate tip to a lateral side of the metal strip for a ground electrode after providing the metal strip extending from the end of the metal shell and before positioning the spacer above the firing end of the center electrode, the metal plate tip being a spark-erosion resistant metal which includes Pt, Ir, Rh, Pd, Re, Os, Ru, Ni or alloy thereof.

6. A method according to claim 1, wherein, a clearance between the spacer and the firing end is maintained during the step of bending the metal strip so as to protect the firing end of the center electrode.

7. A method according to claim 1, wherein, the firing end of the center electrode is made of a tip having a diameter in the range of from 0.3 to 1 mm.

8. A method according to claim 7, wherein, the tip is comprises a metal selected from the group consisting of Pt, Ir, Rh, Pd, Re, Os, Ru or an alloy thereof.

9. A method according to claim 1, wherein the spacer has a rounded portion toward which the metal strip is bent by a punch, in said preliminary bending step.

10. A method according to claim 1, further comprising the steps of:

storing information relating to the position of the firing end of the center electrode in a computer memory; and using said information for positioning the spacer.

11. A method according to claim 1, further comprising the steps of:

storing information relating to the position of the firing end of the center electrode in a computer memory; and using said information for precisely forming a gap-distance between the metal strip and the firing end of the center electrode.

12. A method according to claim 1, wherein the position for the spacer is determined by positional information of the firing end of the center electrode, the positional information being determined with reference to a position of a part constituting the spark plug.

13. A method according to claim 1, wherein positional information of the firing end of the center electrode is measured by use of a position-detecting sensor using a laser.

14. A method according to claim 1, wherein the force applied to the metal strip for precisely forming the gap distance is caused by a die moving in parallel with a center electrode axis.

15. A method according to claim 1, wherein the arc portion to be formed in the metal strip by positioning the spacer is located at substantially the same level as the firing end of the center electrode.

16. An apparatus adapted to perform the method according to claim 1.

17. An apparatus for making a spark plug comprising a center electrode disposed in a bore formed in a ceramic insulator, a metallic shell fitting outside the ceramic insulator, and a ground electrode forming a spark gap with the center electrode, the apparatus comprising:

means for positioning a spacer above a firing end of the center electrode so as to make a clearance between the spacer and the center electrode;

means for preliminarily bending a metal strip toward the spacer without the spacer contacting the center electrode so as to form an arc portion in the metal strip, said metal strip being provided extending from an end of the metal shell and being for forming said ground electrode; and means for precisely forming a gap-distance between the metal strip and the firing end of the center electrode by applying a force to the metal strip.

18. An apparatus according to claim 17, further comprising a position-detecting sensor incorporating a laser, for measuring positional information of the firing end of the center electrode.

19. An apparatus according to claim 17, further comprising a visual-image processor for detecting information on said gap-distance.

20. An apparatus according to claim 18, further comprising a memory for storing said measured positional information and/or said detected gap-distance information.

21. An apparatus according to claim 18, further comprising a CPU for controlling said means for positioning said spacer, said means for preliminarily bending said metal strip and said means for precisely forming said gap-distance, based on said measured and/or stored information.

* * * * *